US007497553B2

(12) United States Patent
Hoshino

(10) Patent No.: US 7,497,553 B2
(45) Date of Patent: Mar. 3, 2009

(54) INKJET RECORDING METHOD AND INKJET RECORDING APPARATUS

(75) Inventor: Yoshihide Hoshino, Hachioji (JP)

(73) Assignee: Konica Minolta Medical & Graphic, Inc., Tokyo (JP)

( * ) Notice: Subject to any disclaimer, the term of this patent is extended or adjusted under 35 U.S.C. 154(b) by 98 days.

(21) Appl. No.: 11/720,218

(22) PCT Filed: Nov. 8, 2005

(86) PCT No.: PCT/JP2005/020457

§ 371 (c)(1),
(2), (4) Date: May 25, 2007

(87) PCT Pub. No.: WO2006/059462

PCT Pub. Date: Aug. 6, 2006

(65) Prior Publication Data

US 2008/0117246 A1 May 22, 2008

(30) Foreign Application Priority Data

Nov. 30, 2004 (JP) ..... 2004-345840
Nov. 30, 2004 (JP) ..... 2004-345905

(51) Int. Cl.
*B41J 2/15* (2006.01)

(52) U.S. Cl. ..... 347/41; 347/102

(58) Field of Classification Search ..... 347/12, 347/15, 41, 100–102
See application file for complete search history.

(56) References Cited

U.S. PATENT DOCUMENTS 7,178,898 B2 * 2/2007 Hoshino ..... 347/40
7,182,453 B2 * 2/2007 Nakajima ..... 347/102

FOREIGN PATENT DOCUMENTS

JP 11208029 8/1999
JP 2003145725 5/2003

* cited by examiner

*Primary Examiner*—Lamson D Nguyen
(74) *Attorney, Agent, or Firm*—Lucas & Mercanti, LLP

(57) ABSTRACT

Provided are a recording head 6 for emitting a photocurable ink onto a recording medium, this photocurable ink being cured by application of light; an ultraviolet irradiation device equipped for applying ultraviolet light to the emitted ink; a carriage drive mechanism 11 for reciprocal scanning movement of the recording head 6 in the direction perpendicular to the direction X for conveying the recording medium P; and a control section 8 for controlling the carriage drive mechanism 11 to form one band by a plurality of reciprocal scanning movements of the recording head 7, and for controlling the recording head 6 to reduce the amount of the ink to be emitted from the recording head 6 in the last movement out of the reciprocal scanning movements required to form one band.

19 Claims, 6 Drawing Sheets

FIG. 4 (a)

| | | | | | |
|---|---|---|---|---|---|
| 1 | 2 | 3 | 1 | 2 | 3 |
| 3 | 1 | 2 | 3 | 1 | 2 |

FIG. 4 (b)

| | | | | | |
|---|---|---|---|---|---|
| 1 | 3 | 5 | 1 | 3 | 5 |
| 2 | 4 | 6 | 2 | 4 | 6 |
| 1 | 3 | 5 | 1 | 3 | 5 |
| 6 | 2 | 4 | 6 | 2 | 4 |

INKJET RECORDING METHOD AND INKJET RECORDING APPARATUS

FIELD OF THE INVENTION

The present invention relates to an inkjet recording method and an inkjet recording apparatus, particularly to an inkjet recording method and an inkjet recording apparatus for recording an image by a serial print method.

BACKGROUND OF THE INVENTION

A recording apparatus based on inkjet method (hereinafter referred to as "inkjet recording apparatus") has been commonly known as an inkjet recording apparatus that can flexibly meet the demands for small batches of a variety of products. In the inkjet recording apparatus, ink is emitted from the nozzle provided on the surface of the recording head arranged face to face with the recording medium, and hits and fixes on the recording medium, whereby an image is recorded on the recording medium. Differently from the image recording means based on the conventional gravure printing or flexographic printing, this method does not require a plate making process, and is capable of meeting a low volume production requirement easily and quickly. This method is also characterized by less noise and easy recoding of a color image through the use of a multi-colored ink.

In recent years, an inkjet recording apparatus using a photocurable ink (e.g., Patent Document 1) is known as an inkjet recording apparatus capable of meeting the requirements of various types of recording media. This apparatus uses a photocurable ink containing a photo-initiator of a predetermined sensitivity to light such as ultraviolet rays, wherein the ink emitted onto a recording medium is cured by exposure to light and is fixed on the recording medium. In the inkjet recording apparatus using such a photocurable ink, the ink having reached the recording medium is instantly cured by exposure to light. This arrangement minimizes the possibility of ink penetrating the recording medium or bleeding thereon, and also ensures an image to be recorded on such recording media as plastic or metallic media that do not absorb ink at all due to lack of an ink receiving layer as well as on plain paper.

The aforementioned inkjet recording apparatus includes a serial print type inkjet recording apparatus that forms an image by the ink emitted from each recording head while scanning by reciprocal movement of the recording head in the main scanning direction, and by intermittent conveyance of a recording medium in the conveyance direction perpendicular to the main scanning direction. This serial print type inkjet recording apparatus has a problem of involving a difference in the color tone and glossiness of the recorded image in the main scanning direction between the movements of the recording head in the outward and homeward directions.

This is because, in the movements of recording head in the outward and homeward directions, there is a difference in the order of the colors of the ink emitted to the recording medium, and therefore, the expansion of dot diameter and cohesion of dots of the ink emitted later vary according to the degree of penetration, wettability and curing of the ink emitted earlier to the recording medium. The expansion of dot diameter and cohesion of the dots of ink depend on the difference in the timing of curing by exposure of light and the intensity of irradiated light.

In the conventional art, to resolve the difference in the color tone or glossiness of the recorded image in the main scanning direction, two sets of recording heads for emitting inks of a plurality of colors are provided symmetrically with respect to the main scanning direction so that difference does not occur to overlapping of inks in the outward and homeward movements in the main scanning direction (e.g., Patent Document 2).

Another conventional technique is found in the inkjet recording apparatus wherein an aqueous ink is used to record an image through adjustment of the ink emission volume (e.g., Patent Document 3).

However, the technique described in the Patent Document 2 requires that recording heads twice as many as the conventional ones should be mounted. This causes an increase in the size and weight of the apparatus.

In the technique described in the Patent Document 3, when an aquatic ink penetrating the recording medium is used, ink emission volume is adjusted in response to the degree of penetration of ink. This technique does not meet the requirements of the photocurable ink wherein there is almost no penetration of ink into the recording medium, and expansion of the ink dot diameter and the dot cohesion of ink depend on the differences in the timing of curing due to exposure to light or intensity of light to be applied.

[Patent Document 1] Unexamined Japanese Patent Application Publication No. 2001-310454

[Patent Document 2] Examined Japanese Patent Application Publication No. 3248704

[Patent Document 3] Unexamined Japanese Patent Application Publication No. 2003-25613

DISCLOSURE OF INVENTION

An object of the present invention is to solve the aforementioned problems and to provide an inkjet recording method and inkjet recording apparatus capable of recording a high-definition image by avoiding occurrence of differences in the color tone and glossiness for each band in the main scanning direction.

The following describes one of the embodiments of the present invention to achieve the aforementioned object:

An inkjet recording method wherein, during scanning by reciprocal movement of a recording head in the direction perpendicular to the direction of conveying a recording medium, the photocurable ink to be cured by application of light is emitted from the aforementioned recording head onto the aforementioned recording medium, and an image is recorded by exposure of the emitted ink to light;

wherein a small amount of ink is emitted from the aforementioned recording head during the last movement of the reciprocal scanning movements required to form one band, when recording is performed so as to form one band by plural reciprocal scanning movements of the aforementioned recording head.

An inkjet recording apparatus including:

a recording head for emitting a photocurable ink onto the recording medium, the photocurable ink being cured by application of light;

a light irradiation apparatus equipped with a light source for applying light to the emitted ink;

a head scanning section for scanning by reciprocal movement of the recording head in the direction perpendicular to the recording medium conveyance direction; and a control section for controlling the aforementioned recording head to reduce the amount of ink emitted from the aforementioned recording head during the last movement of the reciprocal scanning movements required to form one band, when the head scanning section is used for scanning and recording is performed so as to form one band by plural reciprocal scanning movements of the aforementioned recording head.

BRIEF DESCRIPTION OF THE DRAWINGS

FIG. 4 (*a*) is a dot matrix for recording an image of one band by three main scanning movements when the image resolution is the same as that of the head resolution, and FIG. 4 (*b*) is a dot matrix for recording an image of one band by six main scanning movement when the image resolution is twice that of the head resolution;

DESCRIPTION OF SYMBOLS

Figure 1:
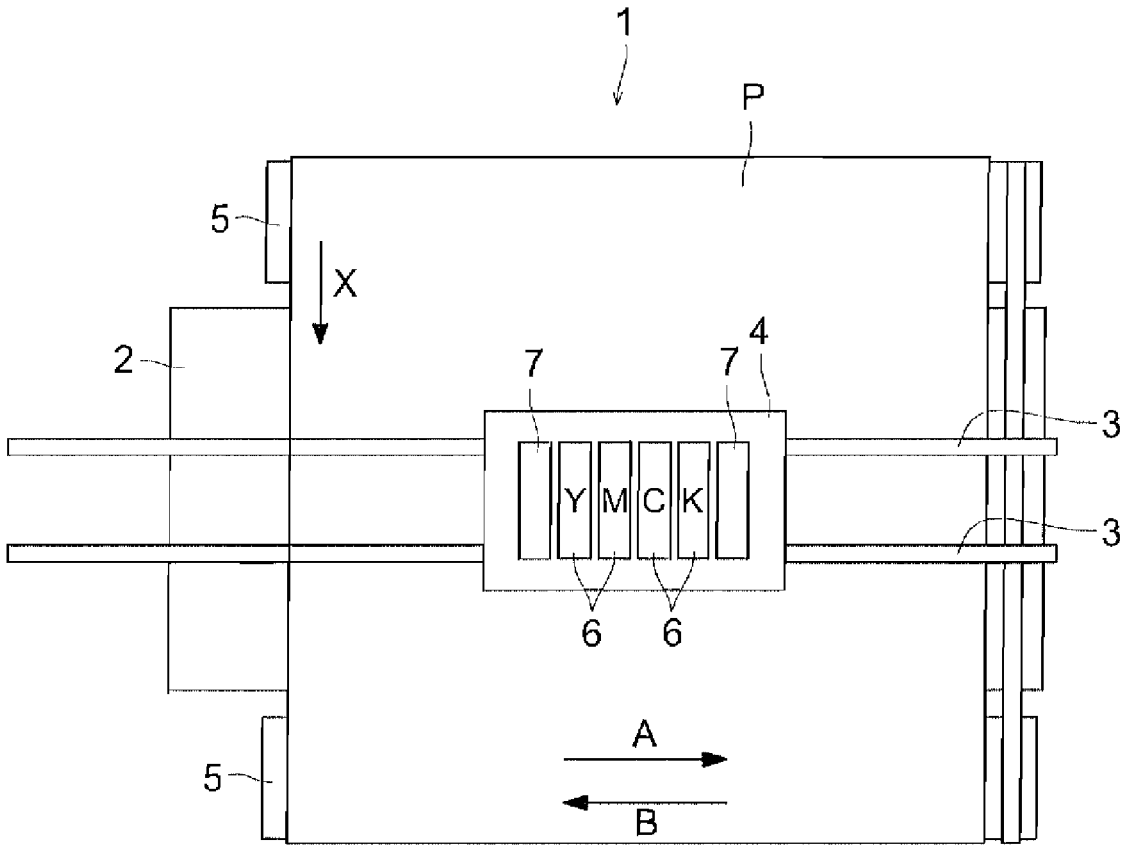
FIG. 1 is a top view showing the structure of the major components of the first embodiment of the inkjet recording apparatus of the present invention.

1. Inkjet recording apparatus
6. Recording head
7. Ultraviolet irradiation device
8. Control section
9. Storing section
P. Recording medium
A. Outward main scanning direction
B. Homeward main scanning direction
X. Conveyance direction

DESCRIPTION OF THE PREFERRED EMBODIMENT

The aforementioned object of the present invention is achieved by the following structures:

(1) An inkjet recording method wherein, during scanning by reciprocal movement of a recording head in the direction perpendicular to the direction of conveying a recording medium, the photocurable ink to be cured by application of light is emitted from the aforementioned recording head onto the aforementioned recording medium, and an image is recorded by exposure of the emitted ink to light;

wherein a small amount of ink is emitted from the aforementioned recording head during the last movement of the reciprocal scanning movements required to form one band, when recording is performed so as to form one band by plural reciprocal scanning movements of the aforementioned recording head.

(2) The inkjet recording method described in the Item 1 wherein a small amount of ink is emitted from the aforementioned recording head during the second last movement of the reciprocal scanning movements required to form one band.

(3) An inkjet recording apparatus including:

a recording head for emitting the photocurable ink onto the recording medium, this photocurable ink being cured by application of light;

a light irradiation apparatus equipped with a light source for applying light to the emitted ink;

a head scanning section for scanning by reciprocal movement of the recording head in the direction perpendicular to the recording medium conveyance direction; and a control section for controlling the recording head to reduce the amount of ink emitted from the aforementioned recording head during the last movement of the reciprocal scanning movements required to form one band, when the head scanning section is used for scanning and recording is performed so as to form one band by plural reciprocal scanning movements of the recording head.

(4) The inkjet recording apparatus described in the Item 3 wherein the control section controls the recording head to reduce the amount of ink emitted from the aforementioned recording head during the second last movement of the reciprocal scanning movements required to form one band.

(5) The inkjet recording apparatus described in the Item 3 wherein the control section controls the recording head so that the amount of ink emitted from the aforementioned recording head during the last movement of the reciprocal scanning movements required to form one band is kept at such a level that the diameter of the ink dot having reached the recording medium is equal to or less than half the distance between the ink dot and an adjacent ink dot having reached the recording medium, or is equal to or greater than the distance between the dots.

(6) The inkjet recording apparatus described in the Item 3 or 5 wherein a plurality of the aforementioned recording heads are arranged, and, in response to the distance between the recording head and light irradiation apparatus, the control section determines the amount of the ink emitted from the recording head during the last movement of the reciprocal scanning movements required to form one band.

(7) The inkjet recording apparatus described in any one of the Items 3, 5 and 6 wherein a plurality of the aforementioned recording heads are arranged to adapt to each of ink colors, and, in response to the type of the ink, the control section determines the amount of the ink emitted from the recording head during the last movement of the reciprocal scanning movements required to form one band.

(8) The inkjet recording apparatus described in any one of the Items 3, 5 and 7 wherein, in response to the type of the recording medium, the control section determines the amount of the ink emitted from the recording head during the last movement of the reciprocal scanning movements required to form one band.

(9) The inkjet recording apparatus described in any one of the Items 3, 5 and 8 wherein, in response to the image recording speed at the time of image recording, the control section determines the amount of the ink emitted from the recording head during the last movement of the reciprocal scanning movements required to form one band.

(10) The inkjet recording apparatus described in any one of the Items 3, 5 and 9 wherein the inkjet recording apparatus includes an irradiation intensity measuring section for measuring the irradiation intensity of the light applied from the light irradiation apparatus, and, in response to the irradiation intensity measured by the irradiation intensity measuring section, the control section determines the amount of the ink emitted from the recording head during the last movement of the reciprocal scanning movements required to form one band.

(11) The inkjet recording apparatus described in any one of the Items 3, 5 and 10 wherein the inkjet recording apparatus includes a temperature and humidity measuring section for measuring at least one of the temperature and humidity around the recording head, and, in response to at least one of the temperature and humidity around the recording head measured by the temperature and humidity measuring section, the control section determines the amount of the ink emitted from the recording head during the last movement of the reciprocal scanning movements required to form one band.

(12) The inkjet recording apparatus described in any one of the Items 3, 5 and 11 wherein, in response to a desired quality of the image to be recorded, the control section determines the amount of the ink emitted from the recording head during the last movement of the reciprocal scanning movements required to form one band.

(13) The inkjet recording apparatus described in the Item 4 wherein the control section controls the recording head so that the amount of ink emitted from the aforementioned recording head during at least one of the last scanning movement and the second last scanning movement of the reciprocal scanning movements required to form one band is kept at such a level that the diameter of the ink dot having reached the recording medium is equal to or less than half the distance between the ink dot and an adjacent ink dot having reached the recording medium, or is equal to or greater than the distance between the dots.

(14) The inkjet recording apparatus described in the Item 4 or 13 wherein a plurality of the aforementioned recording heads are arranged, and, in response to the distance between the recording head and light irradiation apparatus, the control section determines the amount of the ink emitted from the recording head during at least one of the last scanning movement and the second last scanning movement of the reciprocal scanning movements required to form one band.

(15) The inkjet recording apparatus described in any one of the Items 4, 13 and 14 wherein a plurality of the aforementioned recording heads are arranged to adapt to each of ink colors, and, in response to the type of the ink, the control section determines the amount of the ink emitted from the recording head during at least one of the last scanning movement and the second last scanning movement of the reciprocal scanning movements required to form one band.

(16) The inkjet recording apparatus described in any one of the Items 4, 13 and 15 wherein, in response to the type of the recording medium, the control section determines the amount of the ink emitted from the recording head during at least one of the last scanning movement and the second last scanning movement of the reciprocal scanning movements required to form one band.

(17) The inkjet recording apparatus described in any one of the Items 4, 13 and 16 wherein, in response to the image recording speed at the time of image recording, the control section determines the amount of the ink emitted from the recording head during at least one of the last scanning movement and the second last scanning movement of the reciprocal scanning movements required to form one band.

(18) The inkjet recording apparatus described in any one of the Items 4, 13 and 17 wherein the inkjet recording apparatus includes an irradiation intensity measuring section for measuring the irradiation intensity of the light applied from the light irradiation apparatus, and, in response to the irradiation intensity measured by the irradiation intensity measuring section, the control section determines the amount of the ink emitted from the recording head during at least one of the last scanning movement and the second last scanning movement of the reciprocal scanning movements required to form one band.

(19) The inkjet recording apparatus described in any one of the Items 4, 13 and 18 wherein the inkjet recording apparatus includes a temperature and humidity measuring section for measuring at least one of the temperature and humidity around the recording head, and, in response to at least one of the temperature and humidity around the recording head measured by the temperature and humidity measuring section, the control section determines the amount of the ink emitted from the recording head during at least one of the last scanning movement and the second last scanning movement of the reciprocal scanning movements required to form one band.

(20) The inkjet recording apparatus described in any one of the Items 4, 13 and 19 wherein, in response to a desired quality of the image to be recorded, the control section determines the amount of the ink emitted from the recording head during at least one of the last scanning movement and the second last scanning movement of the reciprocal scanning movements required to form one band.

The following describes the details of the measures for solving the aforementioned problems:

To solve the aforementioned problems, the method described in Item 1 is a inkjet recording method wherein, during scanning by reciprocal movement of a recording head in the direction perpendicular to the direction of conveying a recording medium, the photocurable ink to be cured by application of light is emitted from the aforementioned recording head onto the aforementioned recording medium, and an image is recorded by exposure of the emitted ink to light;

wherein a small amount of ink is emitted from the aforementioned recording head during the last movement of the reciprocal scanning movements required to form one band, when recording is performed so as to form one band by plural reciprocal scanning movements of the recording head.

In this case, the amount of ink to be emitted can be reduced by two methods: One is to reduce the amount of the ink emitted from the outlet and the other is to make a random thinning out of outlets for ink emission. The present method includes both of the cases.

In the method described in Item 1, during scanning by reciprocal movement of the recording head in the direction perpendicular to the direction of conveying a recording medium, the photocurable ink is emitted from the recording head, and an image is recorded by exposure of the emitted ink to light. One band is formed by a plurality of reciprocal scanning movements of the recording head. Measures are provided to reduce the amount of ink emitted from the recording head during the last scanning movement in the reciprocal scanning movements required to form one band.

The method described in Item 2 is performed for the inkjet recording method described in the Item 1 so that a small amount of ink is emitted from the aforementioned recording head during the second last movement of the reciprocal scanning movements required to form one band.

Thus, in the method described in Item 2, measures are provided to reduce the amount of ink emitted from the aforementioned recording head during the second last movement of the reciprocal scanning movements required to form one band.

The inkjet recording apparatus in Item 3 includes:

a recording head for emitting the photocurable ink onto a recording medium, this photocurable ink being cured by application of light;

a light irradiation apparatus equipped with a light source for applying light to the emitted ink;

a head scanning section for scanning by reciprocal movement of the recording head in the direction perpendicular to the recording medium conveyance direction; and a control section for controlling the recording head to reduce the amount of ink emitted from the aforementioned recording head during the last movement of the reciprocal scanning movements required to form one band, when the head scanning section is used for scanning and recording is performed so as to form one band by plural reciprocal scanning movements of the recording head.

In the inkjet recording apparatus described in Item 3 having the aforementioned arrangement, during scanning by reciprocal movement of a recording head in the direction perpendicular to the direction of conveying a recording medium, the photocurable ink is emitted from the recording head, and an image is recorded by exposure of the emitted ink to light. One band is formed by a plurality of reciprocal scanning movements of the recording head, and the control section reduces the amount of the ink emitted from the recording head during the last movement of the reciprocal scanning movements required to form one band.

The inkjet recording apparatus in Item 4 is one in Item 3 wherein the control section controls the recording head to reduce the amount of ink emitted from the aforementioned recording head during the second last movement of the reciprocal scanning movements required to form one band.

Thus, in the inkjet recording apparatus described in Item 4, measures are provided to reduce the amount of ink emitted from the aforementioned recording head during the second last movement of the reciprocal scanning movements required to form one band.

As described above, the amount of ink to be emitted can be reduced by two methods: One is to reduce the amount of the ink emitted from the outlet and the other is to make a random thinning out of outlets for ink emission. The following describes the dot diameter of the ink having reached the recording medium in each of these methods:

The inkjet recording apparatus in Item 5 is one in Item 3 wherein the control section controls the recording head so that the amount of ink emitted from the aforementioned recording head during the last movement of the reciprocal scanning movements required to form one band is kept at such a level that the diameter of the ink dot having reached the recording medium is equal to or less than half the distance between the ink dot and an adjacent ink dot having reached the recording medium, when using method of reducing the amount of the ink emitted from the outlet.

Thus, in the inkjet recording apparatus described in Item 5, the control section controls the recording head so that the amount of ink emitted from the aforementioned recording head during the last movement of the reciprocal scanning movements required to form one band is kept at such a level that the diameter of the ink dot having reached the recording medium is equal to or less than half the distance between the ink dot and an adjacent ink dot having reached the recording medium. This arrangement prevents ink dots from being joined to each other on the recording medium.

The inkjet recording apparatus in Item 5 is one in Item 3 wherein the control section controls the recording head so that the amount of ink emitted from the aforementioned recording head during the last movement of the reciprocal scanning movements required to form one band is kept at such a level that the diameter of the ink dot having reached the recording medium is equal to or greater than the distance between the ink dot and an adjacent ink dot having reached the recording medium, when using method of random thinning out of the outlets for ink emission.

Thus, in the inkjet recording apparatus described in Item 5, the control section controls the recording head so that that the amount of ink emitted from the aforementioned recording head during the last movement of the reciprocal scanning movements required to form one band is kept at such a level that the diameter of the ink dot having reached the recording medium is equal to or greater than the distance between the ink dot and an adjacent ink dot having reached the recording medium. This arrangement ensures that ink dots are joined to each other on the recording medium.

The inkjet recording apparatus in Item 6 is one in Item 3 or 5 wherein a plurality of the aforementioned recording heads are arranged, and, in response to the distance between the recording head and light irradiation apparatus, the control section determines the amount of the ink emitted from the recording head during the last movement of the reciprocal scanning movements required to form one band.

In this case, the amount of the ink emitted can be determined in two methods: One is the method of determining the amount of the ink emitted from the outlet and the other is the method of determining the ratio of thinning-out, which is performed by random thinning out of the outlets for emission. The present apparatus includes both methods.

Thus, in the inkjet recording apparatus described in Item 6, when a plurality of the recording heads are arranged, in response to the distance between the recording head and light irradiation apparatus, the control section determines the amount of the ink emitted from the recording head during the last movement of the reciprocal scanning movements required to form one band.

The inkjet recording apparatus in Item 7 is one described in any one of the Items 3, 5 and 6 wherein a plurality of the recording heads are arranged to adapt to each of ink colors, and, in response to the type of the ink, the control section determines the amount of the ink emitted from the recording head during the last movement of the reciprocal scanning movements required to form one band.

Thus, in the inkjet recording apparatus described in Item 7, when a plurality of the recording heads are arranged to adapt to each of ink colors, in response to the type of the ink, the control section determines the amount of the ink emitted from the recording head during the last movement of the reciprocal scanning movements required to form one band.

The inkjet recording apparatus in Item 8 is one described in any one of the Items 3, 5 and 7 wherein, in response to the type of the recording medium, the control section determines the amount of the ink emitted from the recording head during the last movement of the reciprocal scanning movements required to form one band.

Thus, in the inkjet recording apparatus described in Item 8, in response to the type of the recording medium, the control section determines the amount of the ink emitted from the recording head during the last movement of the reciprocal scanning movements required to form one band.

The inkjet recording apparatus in Item 9 is one described in any one of the Items 3, 5 and 8 wherein, in response to the image recording speed at the time of image recording, the control section determines the amount of the ink emitted from the recording head during the last movement of the reciprocal scanning movements required to form one band.

Thus, in the inkjet recording apparatus described in Item 9, in response to the image recording speed at the time of image recording, the control section determines the amount of the ink emitted from the recording head during the last movement of the reciprocal scanning movements required to form one band.

The inkjet recording apparatus in Item 10 is one described in any one of the Items 3, 5 and 9 wherein the inkjet recording apparatus includes an irradiation intensity measuring section for measuring the irradiation intensity of the light applied from the light irradiation apparatus, and, in response to the irradiation intensity measured by the irradiation intensity measuring section, the control section determines the amount of the ink emitted from the recording head during the last movement of the reciprocal scanning movements required to form one band.

Thus, in the inkjet recording apparatus described in Item 10, the irradiation intensity of the light is measured by an irradiation intensity measuring section and, in response to the result of this measurement, the control section determines the amount of the ink emitted from the recording head during the last movement of the reciprocal scanning movements required to form one band.

The inkjet recording apparatus in Item 11 is one described in any one of the Items 3, 5 and 10 wherein the inkjet recording apparatus includes a temperature and humidity measuring section for measuring at least one of the temperature and humidity around the recording head, and, in response to at least one of the temperature and humidity around the recording head measured by the temperature and humidity measuring section, the control section determines the amount of the ink emitted from the recording head during the last movement of the reciprocal scanning movements required to form one band.

Thus, in the inkjet recording apparatus described in Item 11, at least one of the temperature and humidity around the recording head is measured by the temperature and humidity measuring section, and, in response to the result of the measurement by the temperature and humidity measuring section, the control section determines the amount of the ink emitted from the recording head during the last movement of the reciprocal scanning movements required to form one band.

The inkjet recording apparatus in Item 12 is one described in any one of the Items 3, 5 and 11 wherein, in response to a desired quality of the image to be recorded, the control section determines the amount of the ink emitted from the recording head during the last movement of the reciprocal scanning movements required to form one band.

Thus, in the inkjet recording apparatus described in Item 12, in response to a desired quality of the image selected by a selection setting section, the control section determines the amount of the ink emitted from the recording head during the last movement of the reciprocal scanning movements required to form one band.

The inkjet recording apparatus in Item 13 is one described in any one of the Item 4 wherein the control section controls the recording head so that the amount of ink emitted from the aforementioned recording head during at least one of the last scanning movement and the second last scanning movement of the reciprocal scanning movements required to form one band is kept at such a level that the diameter of the ink dot having reached the recording medium is equal to or less than half the distance between the ink dot and an adjacent ink dot having reached the recording medium, when using the method of reducing the amount of the ink emitted from the outlet.

Thus, in the inkjet recording apparatus described in Item 13, the control section controls the recording head so that the amount of ink emitted from the aforementioned recording head during at least one of the last scanning movement and the second last scanning movement of the reciprocal scanning movements required to form one band is kept at such a level that the diameter of the ink dot having reached the recording medium is equal to or less than half the distance between the ink dot and an adjacent ink dot having reached the recording medium. This arrangement prevents ink dots from being joined to each other on the recording medium.

The inkjet recording apparatus in Item 13 is one described in any one of the Item 4 wherein the control section controls the recording head so that the amount of ink emitted from the aforementioned recording head during at least one of the last scanning movement and the second last scanning movement of the reciprocal scanning movements required to form one band is kept at such a level that the diameter of the ink dot having reached the recording medium is equal to or greater than the distance between the ink dot and an adjacent ink dot having reached the recording medium, when using the method of random thinning out of the outlets for emission.

Thus, in the inkjet recording apparatus described in Item 13, the control section controls the recording head so that the amount of ink emitted from the aforementioned recording head during at least one of the last scanning movement and the second last scanning movement of the reciprocal scanning movements required to form one band is kept at such a level that the diameter of the ink dot having reached the recording medium is equal to or greater than the distance between the ink dot and an adjacent ink dot having reached the recording medium. This arrangement ensures that ink dots are joined to each other on the recording medium.

The inkjet recording apparatus in Item 14 is one described in any one of the Item 4 or 13 wherein a plurality of the aforementioned recording heads are arranged, and, in response to the distance between the recording head and light irradiation apparatus, the control section determines the amount of the ink emitted from the recording head during at least one of the last scanning movement and the second last scanning movement of the reciprocal scanning movements required to form one band.

Thus, in the inkjet recording apparatus described in Item 14, when a plurality of the aforementioned recording heads are arranged, in response to the distance between the recording head and light irradiation apparatus, the control section determines the amount of the ink emitted from the recording head during at least one of the last scanning movement and the second last scanning movement of the reciprocal scanning movements required to form one band.

The inkjet recording apparatus in Item 15 is one described in any one of the Items 4, 13 and 14 wherein a plurality of the recording heads are arranged to adapt to each of ink colors, and, in response to the type of the ink, the control section determines the amount of the ink emitted from the recording head during at least one of the last scanning movement and the second last scanning movement of the reciprocal scanning movements required to form one band.

Thus, in the inkjet recording apparatus described in Item 15, when a plurality of the recording heads are arranged to adapt to each of ink colors, in response to the type of the ink, the control section determines the amount of the ink emitted from the recording head during at least one of the last scanning movement and the second last scanning movement of the reciprocal scanning movements required to form one band.

The inkjet recording apparatus in Item 16 is one described in any one of the Items 4, 13 and 15 wherein, in response to the type of the recording medium, the control section determines the amount of the ink emitted from the recording head during at least one of the last scanning movement and the second last scanning movement of the reciprocal scanning movements required to form one band.

Thus, in the inkjet recording apparatus described in Item 16, in response to the type of the recording medium, the control section determines the amount of the ink emitted from the recording head during at least one of the last scanning movement and the second last scanning movement of the reciprocal scanning movements required to form one band.

The inkjet recording apparatus in Item 17 is one described in any one of the Items 4, 13 and 16 wherein, in response to the image recording speed at the time of image recording, the control section determines the amount of the ink emitted from the recording head during at least one of the last scanning movement and the second last scanning movement of the reciprocal scanning movements required to form one band.

Thus, in the inkjet recording apparatus described in Item 17, in response to the image recording speed at the time of image recording, the control section determines the amount of the ink emitted from the recording head during at least one of the last scanning movement and the second last scanning movement of the reciprocal scanning movements required to form one band.

The inkjet recording apparatus in Item 18 is one described in any one of the Items 4, 13 and 17 wherein the inkjet recording apparatus includes an irradiation intensity measuring section for measuring the irradiation intensity of the light applied from the light irradiation apparatus, and, in response to the irradiation intensity measured by the irradiation intensity measuring section, the control section determines the amount of the ink emitted from the recording head during at least one of the last scanning movement and the second last scanning movement of the reciprocal scanning movements required to form one band.

Thus, in the inkjet recording apparatus described in Item 18, the irradiation intensity of the light is measured by the irradiation intensity measuring section and, in response to the result of this measurement, the control section determines the amount of the ink emitted from the recording head during at least one of the last scanning movement and the second last scanning movement of the reciprocal scanning movements required to form one band.

The inkjet recording apparatus in Item 19 is one described in any one of the Items 4, 13 and 18 wherein the inkjet recording apparatus includes a temperature and humidity measuring section for measuring at least one of the temperature and humidity around the recording head, and, in response to at least one of the temperature and humidity around the recording head measured by the temperature and humidity measuring section, the control section determines the amount of the ink emitted from the recording head during at least one of the last scanning movement and the second last scanning movement of the reciprocal scanning movements required to form one band.

Thus, in the inkjet recording apparatus described in Item 19, at least one of the temperature and humidity around the recording head is measured by the temperature and humidity measuring section, and, in response to the result of measurement by the temperature and humidity measuring section, the control section determines the amount of the ink emitted from the recording head during at least one of the last scanning movement and the second last scanning movement of the reciprocal scanning movements required to form one band.

The inkjet recording apparatus in Item 20 is one described in any one of the Items 4, 13 and 19 wherein, in response to a desired quality of the image to be recorded, the control section determines the amount of the ink emitted from the recording head during at least one of the last scanning movement and the second last scanning movement of the reciprocal scanning movements required to form one band.

Thus, in the inkjet recording apparatus described in Item 20, in response to a desired image quality selected by the selection setting section, the control section determines the amount of the ink emitted from the recording head during at least one of the last scanning movement and the second last scanning movement of the reciprocal scanning movements required to form one band.

The following describes the effects of the present invention:

The amount of ink to be emitted in the last scanning movement for each band gives the greatest effect to the image quality when the recorded image is visually recognized. In the method described in Item 1, the amount of ink to be emitted at the time of the last scanning movement is smaller than the amount of ink to be emitted at the time of other scanning movements. To be more specific, the amount of the ink emitted from the outlet is reduced, or the outlets for emission are thinned out at random. This arrangement minimizes cohesion of emitted inks on the recording medium, and prevents differences from occurring to the color tone and glossiness of the recorded image between the outward and homeward movements of the recording head in the main scanning direction, whereby high-definition image recording is ensured.

Further, only the amount of ink emitted during the last scanning movement is reduced. This eliminates the possibility of the overall amount of ink on the image being reduced, and the possibility of the density of the recorded image being reduced. Thus, only the occurrence of differences in the color tone and glossiness of the recorded image for each band is avoided, and high-definition image recording is provided.

At the time of multiple scanning movements to form one band, almost all the pixels are covered by the first few scanning movements. Accordingly, even if the amount of ink to be emitted is reduced in the second last scanning movement as well as in the last scanning movement, almost no effect is given to the image quality. After almost all the pixels have been covered, it is more effective to minimize the amount of ink to be emitted so as to prevent differences from occurring to the color tone and glossiness of recorded image. This is because this arrangement prevents cohesion from occurring between ink dots when using the method of reducing the amount of the ink emitted from the outlet, and randomizes the cohesion when using the method of random thinning out of the outlets for emission. According to the method described in Item 2, the amount of the ink to be emitted is reduced during both the last scanning movement and the second last scanning movement. As compared to the case of increasing the amount of ink to be reduced in one scanning movement, more uniform ink emission and smoother image surfaces are provided, whereby high-definition image recording can be ensured.

The amount of ink to be emitted at the time of last scanning movement for each band gives the greatest effect to the image quality when the recorded image is visually recognized. In the apparatus described in Item 3, the amount of ink to be emitted during the last scanning movement is smaller than that during other scanning movements. Thus, this arrangement minimizes cohesion of emitted inks on the recording medium, when using the method of reducing the amount of the ink emitted from the outlet. When using the method of random thinning out of the outlets for emission, this arrangement causes cohesion of emitted inks to occur at random on the recording medium, and prevents differences from occurring to the color tone and glossiness of the recorded image between the outward and homeward movements of the recording head in the main scanning direction, whereby high-definition image recording can be provided.

Further, only the amount of ink emitted during the last scanning movement is reduced. This eliminates the possibility of the overall amount of ink on the image being reduced, and the possibility of the density of the recorded image being reduced. Thus, only the occurrence of differences in the color tone and glossiness of the recorded image for each band is avoided, and high-definition image recording is provided.

At the time of multiple scanning movements to form one band, almost all the pixels are covered by the first few scanning movements. Accordingly, even if the amount of ink to be emitted is reduced in the second last scanning movement as well as in the last scanning movement, almost no effect is given to the image quality. After almost all the pixels have been covered, it is more effective to minimize the amount of ink to be emitted so as to prevent differences from occurring to the color tone and glossiness of recorded image. This is because this arrangement prevents cohesion from occurring between ink dots when using the method of reducing the amount of the ink emitted from the outlet, and randomizes the cohesion when using the method of random thinning out of the outlets for emission. According to the apparatus described in Item 4, the amount of the ink to be emitted is reduced during both the last scanning movement and the second last scanning movement. As compared to the case of increasing the amount of ink to be reduced in one scanning movement, more uniform ink emission and smoother image surfaces are provided, whereby high-definition image recording can be ensured.

According to the apparatus described in Item 5, when using the method of reducing the amount of the ink emitted from the outlet, the amount of ink to be emitted in the last scanning movement is kept at such a level that the diameter of the ink dot having reached the recording medium is equal to or less than half the distance between the ink dot and an adjacent ink dot having reached the recording medium. This arrangement eliminates the possibility of cohesion of adjacent inks emitted in the last scanning movement, and prevents differences from occurring to the color tone and glossiness of the recorded image, whereby high-definition image recording is ensured.

According to the apparatus described in Item 5, when using the method of random thinning out of the outlets for emission, the amount of ink to be emitted in the last scanning movement is kept at such a level that the diameter of the ink dot having reached the recording medium is equal to or greater than the distance between the ink dot and an adjacent ink dot having reached the recording medium. This arrangement causes cohesion of adjacent inks among inks emitted at random in the last scanning movement, and prevents differences from occurring to the color tone and glossiness of the recorded image, whereby high-definition image recording is ensured.

When the recording head is located close to the light irradiation apparatus at the time of image recording using a photocurable ink, light is immediately applied to the ink emitted onto the recording medium, and the ink is immediately cured after its arrival at the recording medium. By contrast, when the recording head is located far from the light irradiation apparatus, the ink emitted onto the recording medium is not immediately exposed to light, and therefore, ink spreads nearby to form a smooth surface before the ink is cured after arrival at the recording medium. According to the apparatus described in Item 6, the amount of the ink to be emitted in the last scanning movement (the amount of ink emitted from the outlet when using the method of reducing the amount of the ink emitted from the outlet, and ink thinning rate when using the method of random thinning out of the outlets for emission) is determined with consideration given to the timing for curing the ink. This arrangement provides high-definition image recording, for example, even in the inkjet recording apparatus which allows switching between the recording operations at different image recording speeds.

When a plurality of ink colors are used for image recording, there may be a difference in the easiness of cohesion of ink dots or the way of curing, depending on the type of ink. According to the apparatus described in Item 7, the amount of the ink to be emitted in the last scanning movement is determined in response to the type of ink. This arrangement ensures high-definition image recording according to various types of inks.

There is a difference in ink absorption or surface energy depending on the type of the recording medium. The way ink spreads at the recording medium after its arrival differs according to the type of the recording medium. According to the apparatus described in Item 8, the amount of the ink to be emitted can be adjusted in response to the recording medium, whereby high-definition image recording is provided.

When the image recording speed is high at the time of image recording using a photocurable ink, light is immediately applied to the ink emitted onto the recording medium, and the ink is immediately cured after its arrival at the recording medium. By contrast, when the image recording speed is low, the ink emitted onto the recording medium is not immediately exposed to light, and therefore, ink spreads nearby to form a smooth surface before the ink is cured after arrival at the recording medium. According to the apparatus described in Item 9, the amount of the ink to be emitted in the last scanning movement is determined with consideration given to the timing for curing the ink. This arrangement provides high-definition image recording, for example, even in the inkjet recording apparatus which allows switching between the recording operations at different image recording speeds.

The ink emitted onto the recording medium is cured differently depending on the amount of the light irradiation in the light irradiation apparatus. If there is a larger quantity of light irradiation, ink is immediately cured after arrival at the recording medium. If there is a smaller quantity of light irradiation, ink spreads nearby to form a smooth surface without being immediately cured after arrival at the recording medium. According to the apparatus described in Item 10, the amount of the ink to be emitted in the last scanning movement is determined with consideration given to the different mode of ink curing. This arrangement satisfies the requirements even when there is a difference in the number of scanning movements required to cure the ink, and provides high-definition image recording at all times.

Ink is not easily cured when the temperature around the recording head is lower and the humidity is higher. It spreads nearby to form a smooth surface without being immediately cured after arrival at the recording medium. Ink is easily cured when the temperature around the recording head is higher and the humidity is lower. According to the apparatus described in Item 11, the amount of the ink to be emitted in the last scanning movement is determined with consideration given to such ink characteristics. This arrangement provides high-definition image recording.

The apparatus described in Item 12 prevents a difference from being caused in the color tone and glossiness of an image for each band, and allows a user to select such an image quality as matte pattern and gloss tone, as desired. This arrangement ensures high-definition image recording and provides an image of the quality conforming to the user's preference.

According to the apparatus described in Item 13, when using the method of reducing the amount of the ink emitted from the outlet, the amount of ink emitted from the aforementioned recording head during at least one of the last scanning movement and the second last scanning movement is kept at such a level that the diameter of the ink dot having reached the recording medium is equal to or less than half the distance between the ink dot and an adjacent ink dot having reached the recording medium. This arrangement avoids cohesion of adjacent inks emitted in the last scanning movement or second last scanning movement, and prevents differences from occurring to the color tone and glossiness of the recorded image, whereby high-definition image recording is ensured.

According to the apparatus described in Item 13, when using the method of random thinning out of the outlets for emission, the amount of ink emitted from the aforementioned recording head during at least one of the last scanning movement and the second last scanning movement is kept at such a level that the diameter of the ink dot having reached the recording medium is equal to or greater than the distance between the ink dot and an adjacent ink dot having reached the recording medium. This arrangement causes cohesion of adjacent inks among inks emitted in the last scanning movement or second last scanning movement, and prevents differences from occurring to the color tone and glossiness of the recorded image, whereby high-definition image recording is ensured.

When the recording head is located close to the light irradiation apparatus at the time of image recording using a photocurable ink, light is immediately applied to the ink emitted onto the recording medium, and the ink is immediately cured after its arrival at the recording medium. By contrast, when the recording head is located far from the light irradiation apparatus, the ink emitted onto the recording medium is not immediately exposed to light, and therefore, ink spreads nearby to form a smooth surface before the ink is cured after arrival at the recording medium. According to the apparatus described in Item 14, the amount of the ink to be emitted in the last scanning movement or second last scanning movement is determined with consideration given to the timing for curing the ink. This arrangement provides high-definition image recording, for example, even in the inkjet recording apparatus which allows switching between the recording operations at different image recording speeds.

When a plurality of ink colors are used for image recording, there may be a difference in the easiness of cohesion of ink dots or the way of curing, depending on the type of ink. According to the apparatus described in Item 15, the amount of the ink to be emitted in the last scanning movement or second last scanning movement is determined in response to the type of ink. This arrangement ensures high-definition image recording when various types of inks are used.

There is a difference in ink absorption or surface energy depending on the type of the recording medium. The spread of ink after arrival at the recording medium differs according to the type of the recording medium. According to the apparatus described in Item 16, the amount of the ink to be emitted can be adjusted in response to the recording medium, whereby high-definition image recording is provided.

When the image recording speed is high at the time of image recording using a photocurable ink, light is immediately applied to the ink emitted onto the recording medium, and the ink is immediately cured after its arrival at the recording medium. By contrast, when the image recording speed is low, the ink emitted onto the recording medium is not immediately exposed to light, and therefore, ink spreads nearby to form a smooth surface before the ink is cured after arrival at the recording medium. According to the apparatus described in Item 17, the amount of the ink to be emitted in the last scanning movement or second last scanning movement is determined with consideration given to the timing for curing the ink. This arrangement provides high-definition image recording, for example, even in the inkjet recording apparatus which allows switching between the recording operations at different image recording speeds.

The ink emitted onto the recording medium is cured differently depending on the amount of the light irradiation in the light irradiation apparatus. If there is a larger quantity of light irradiation, ink is immediately cured after arrival at the recording medium. If there is a smaller quantity of light irradiation, ink spreads nearby to form a smooth surface without being immediately cured after arrival at the recording medium. According to the apparatus described in Item 18, the amount of the ink to be emitted in the last scanning movement or second last scanning movement is determined with consideration given to the different mode of ink curing. This arrangement satisfies the requirements even when there is a difference in the number of scanning movements required to cure the ink, and provides high-definition image recording at all times.

Ink is not easily cured when the temperature around the recording head is lower and the humidity is higher. It spreads nearby to form a smooth surface without being immediately cured after arrival at the recording medium. Ink is easily cured when the temperature around the recording head is higher and the humidity is lower. According to the apparatus described in Item 19, the amount of the ink to be emitted in the last scanning movement or second last scanning movement is determined with consideration given to such ink characteristics. This arrangement provides high-definition image recording.

The apparatus described in Item 20 prevents a difference from being caused in the color tone and glossiness of an image for each band, and allows a user to select such an image quality as matte pattern and gloss tone, as desired. This arrangement ensures high-definition image recording and provides an image of the quality conforming to the user's preference.

Referring to FIGS. 1 through 6 the following describes the first embodiment of the inkjet recording method and inkjet recording apparatus of the present invention.

As shown in FIG. 1, the inkjet recording apparatus 1 of the present invention is an inkjet recording apparatus 1 based on serial print method. This inkjet recording apparatus 1 is provided with a platen 2 formed in a planar shape to support the recording medium P from the non-recording surface.

A rod-shaped guide rail 3 extending in the longitudinal direction of the platen 2 is provided above the platen 2. This guide rail 3 supports a carriage 4, and the carriage 4 is designed to move freely to perform reciprocal scanning along a guide rail 4 in the main scanning directions A and B by means of a carriage drive mechanism 11 (FIG. 2) as a head scanning device.

The inkjet recording apparatus 1 contains a plurality of conveyance rollers 5, and is provided with a recording medium conveyance mechanism 12 (FIG. 2) for feeding the recording medium P in the conveyance direction X perpendicular to the main scanning directions A and B. The recording medium conveyance mechanism 12 repeats conveyance and stop of the recording medium P in conformity with the movement of the carriage 4 at the time of image recording through the rotation of the conveyance rollers 5, so that the recording medium P is conveyed intermittently to the downstream portion from the upstream in the conveyance direction X.

As shown in FIG. 1, the carriage 4 is provided with four recording heads 6 corresponding to the colors (black (K), cyan (C), magenta (M), yellow (Y)) used in the inkjet recording apparatus 1 of the present invention. The recording heads 6 each have an outside configuration shaped approximately in a rectangular parallelepiped, and are parallel to one another in the longitudinal direction. A plurality of ink outlets (not illustrated) shaped in rows in the longitudinal direction of the recording head 6 are provided on the surface of the recording head 6 facing the recording medium P. Each of the recording heads 6 has an ink outlet for emitting ink. It should be noted that the ink that can be used in the inkjet recording apparatus 1 is not restricted thereto. For example, it is possible of use the inks of light yellow (LY), light magenta (LM), light cyan (LC). In this case, the recording heads conforming to these colors are mounted on the carriage.

Further, a temperature and humidity sensor 13 (FIG. 2) is arranged close to the recording head 6. This is a temperature and humidity measuring device for measuring the temperature and humidity around the recording head 6. The temperature and humidity sensor 13 includes a thermister as a temperature detecting element and a high molecular resistance type humidity sensor equipped with a humidity detecting element, for example. It is used to detect the ambient temperature and humidity around the recording head 6. It should be noted that, without being restricted thereto, the temperature and humidity measuring section can be designed in other structures.

An ultraviolet irradiation device 7 as a light irradiation apparatus is provided between the recording heads 6 arranged adjacent to the side walls of the carriage 4 and the walls on both sides of the carriage 4.

The ultraviolet irradiation device 7 has an ultraviolet light source (not illustrated) for applying ultraviolet rays as the rays for curing and fixing the ink emitted and having reached the recording medium P. The ultraviolet light source that can be used here is exemplified by a high-pressure mercury lamp, a low-pressure mercury lamp, a metal halide lamp, a semiconductor laser, a cold-cathode tube, and an excimer lamp or an LED (Light Emitting Diode).

An ultraviolet sensor 14 (FIG. 2) is provided close to the ultraviolet irradiation device 7. This sensor constitutes an irradiation intensity measuring section for measuring the irradiation intensity of the ultraviolet rays emitted from the ultraviolet irradiation device 7. The ultraviolet sensor 14 detects the intensity of the ultraviolet rays received by the light receiving section equipped with a silicon sensor and optical filter. It should be noted that, without being restricted thereto, the irradiation intensity measuring section can be designed in other structures.

The ink used in the present embodiment is the photocurable ink that has a characteristic of being cured by irradiation of ultraviolet rays. Its main components contain at least a polymerizable compound (including a commonly known polymerizable compound), a photo initiator and a color material. The aforementioned photocurable ink as a polymerizable compound can be broadly classified into two types; a radical polymerization system ink including a radical polymerizable compound, and a cationic polymerization system ink including a cationic polymerizable compound. These two types of ink can be used in the present embodiment. A hybrid type ink as a composition of the radical polymerization system ink and cationic polymerization system ink can be used in the present embodiment. However, superior functionality and versatility are provided by the cationic polymerization system ink with little or no effect of inhibiting the polymerization reaction due to oxygen, and therefore, the cationic polymerization system ink in particular is preferably used. The cationic polymerization system ink is a mixture containing at least a cationic polymerizable compound such as a oxetane compound, epoxy compound and vinyl ether compound, and an optical cationic initiator and a color material.

The recording medium P that can be used is made of various types of paper such as plain paper, recycled paper and glossy paper, various types of fabrics, various types of non-woven fabrics, and various types of materials such as resin, metal and glass. The recording medium P can be configured in various types of forms such as a roll, cut sheet or plate.

Figure 2:
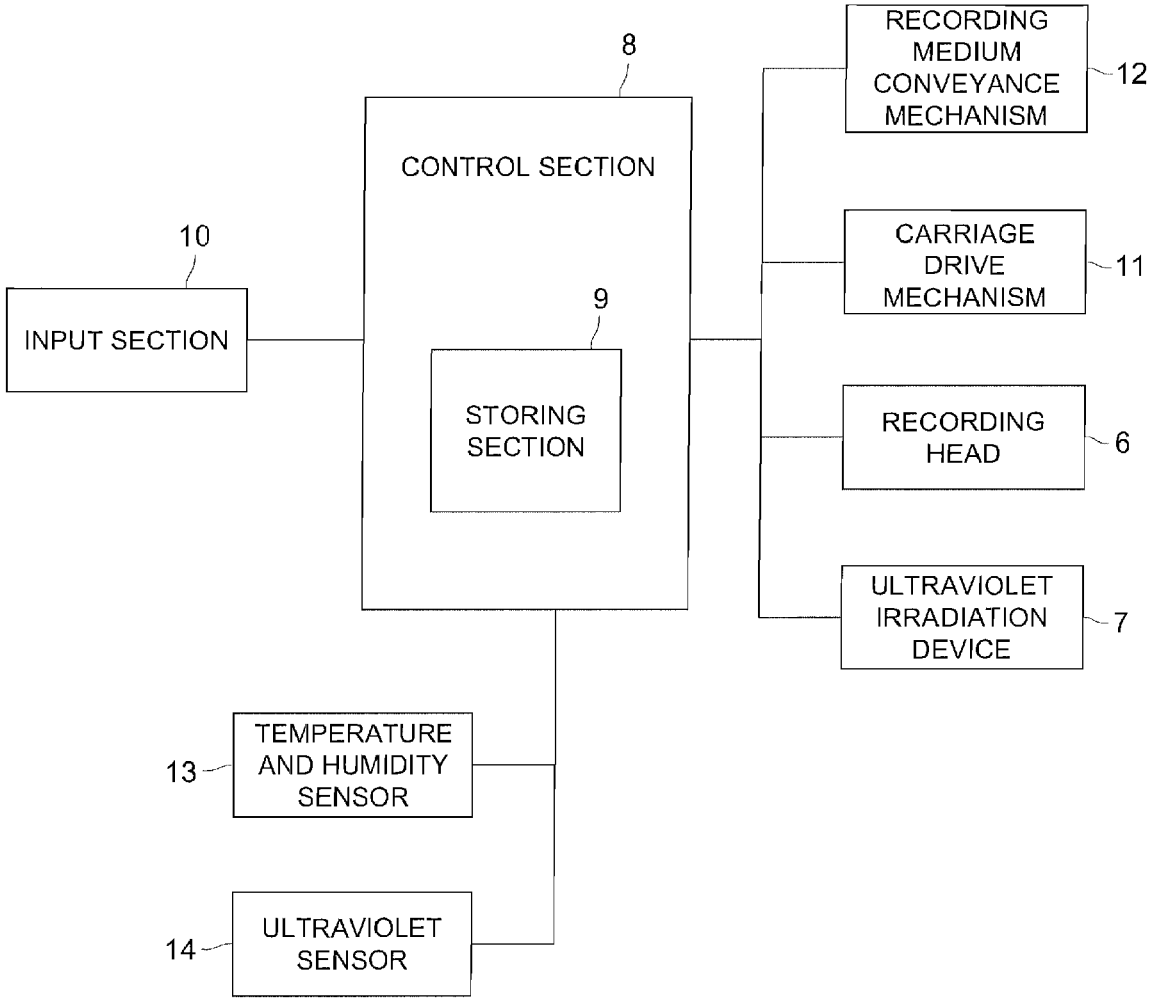
FIG. 2 is a major component block diagram showing the outline of the control structure of the first embodiment of the inkjet recording apparatus in the present embodiment.

Referring to FIGS. 2 through 6, the following describes the control structure of the inkjet recording apparatus 1 of the present invention:

As shown in FIG. 2, the inkjet recording apparatus 1 is provided with a control section 8 for controlling each section of the apparatus. This control section 8 has a CPU (Central Processing Unit) (not illustrated). It contains storing section 9 made up of a ROM (Read Only Memory) for storing various types of processing programs, and a RAM (Random Access Memory) for temporary storage of various types of data including image data (all not illustrated). The processing programs recorded in the ROM are expanded in the RAM working area by the control section 8. This processing program is executed by the CPU.

The inkjet recording apparatus 1 is also provided with an input section 10 for inputting the type of the recording medium P and image recording conditions. The information inputted from the input section 10 is fed to the control section 8. The input section 10 is exemplified by a keyboard or operation panel. By operating the input section 10, the user can select and set various types of image recording conditions for the recording medium P used in the image recording, a desired image recording speed and resolution or the like.

The control section 8 is designed to feed the result of measurement by the temperature and humidity sensor 13 and ultraviolet sensor 14. The control section 8 controls various sections based on the result having been supplied.

The control section 8 controls the carriage drive mechanism 11, and causes the carriage 4 to perform reciprocal scanning in the main scanning directions A and B. At the same time, it controls the operation of the recording medium conveyance mechanism 12 in such a way as to cause intermittent conveyance of the recording medium P in the conveyance direction X in conformity to the operation of the carriage 4.

Further, the control section 8 is supplied with the image data relating to the recorded image from an external apparatus (not illustrated). The control section 8 operates the recording head 6, based on the image data having been supplied and the information inputted from the input section 10. This causes a proper amount of ink to be emitted from each recording head 6, whereby a predetermined image is recorded on the recording medium P.

When using the method of reducing the amount of the ink emitted from the outlet, the amount of ink to be emitted is defined as a product of the amount of the ink particle emitted from the outlet of the recording head 6 and the number of ink particles to be emitted. To ensure that the determined amount of ink is emitted, the control section 8 controls the amount of ink particles emitted from each recording head 6 or the number of ink particles, whereby the amount of the ink to be emitted is adjusted.

When using the method of random thinning out of the outlets for emission, the ink thinning rate is defined as the number of the outlets of the recording head 6 from which ink is not emitted, with respect to the number of the outlets of the recording head 6. To ensure that the ink at a predetermined thinning rate is emitted, the control section 8 adjusts the number of the outlets through which ink is emitted from the recording head 6.

Further, the control section 8 controls the ultraviolet irradiation device 7, and applies ultraviolet rays to the ink emitted on the recording medium P.

Figure 3:
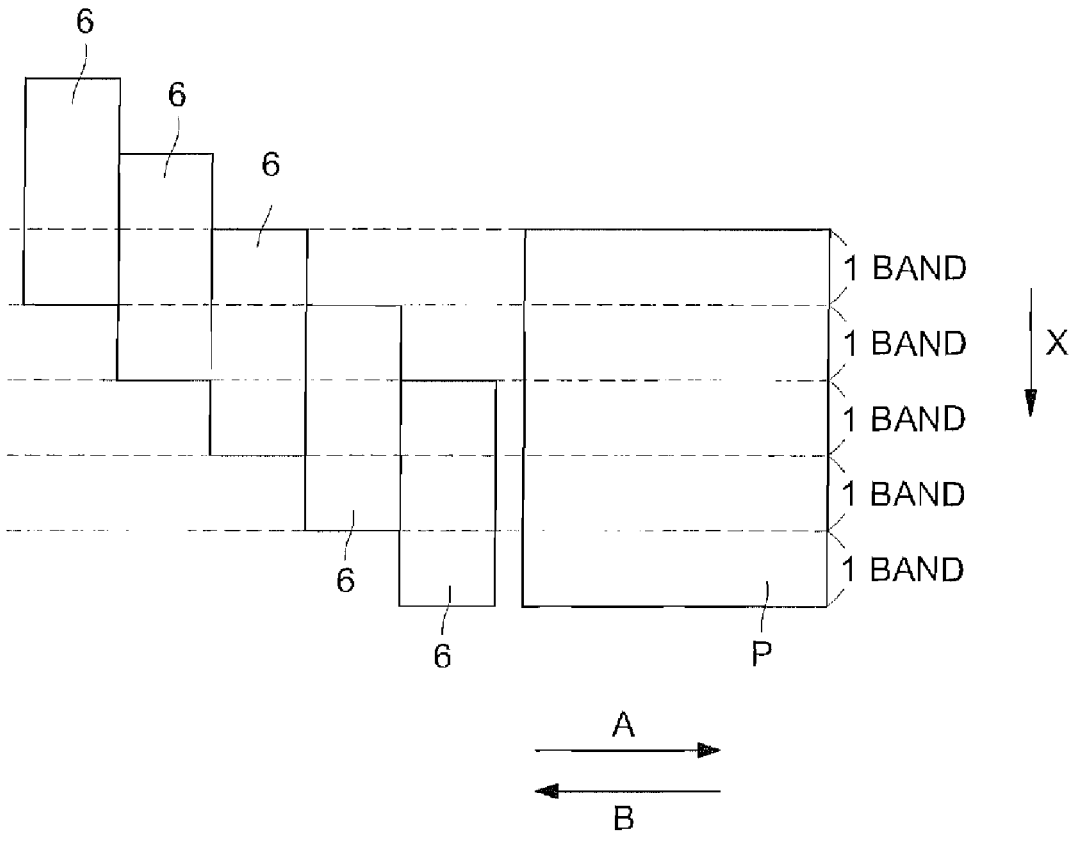
FIG. 3 is a drawing representing the corresponding position of the recording head for image formation of each band.

The following describes how the control section 8 of the present embodiment controls the amount of the ink to be emitted:

FIG. 3 is a drawing representing the corresponding position of the recording heads 6 for image formation of each band, wherein attention is paid to one of the recording heads 6. As shown in FIG. 3, one band refers to the feed width of the recording medium P conveyed in one step of conveyance. In the present embodiment, by means of three scanning movements on one band, an image recording operation is conducted. To be more specific, for the top band of the recording medium P in FIG. 3, for example, the first scanning movement is carried out in the main scanning direction A (outward direction). The image recording in the first scanning movement is performed by the ink emitted from one end of the recording head 6. Then the second scanning movement is carried out in the main scanning direction B (homeward direction). The image recording in the second scanning movement is performed by the ink emitted from approximately the center of the recording head 6. Further, the third scanning movement is carried out again in the main scanning direction A (outward direction). The image recording in the third scanning movement is performed by the ink emitted from the other end of the recording head 6. This completes recording for all the pixels in one band.

When using the method of reducing the amount of the ink emitted from the outlet, to ensure that the amount of the ink to be emitted in the last scanning movement of the three scanning movements is smaller than that in other scanning movements, the control section 8 controls the recording head 6 so as to reduce the amount of the ink to be emitted from the outlet for emitting ink to the portion recorded in the last scanning movement in each band, out of the ink outlets of the recording heads 6. The amount of the ink to be emitted is preferably kept at such a level that the diameter of the ink dot having reached the recording medium is equal to or less than half the distance between the ink dot and an adjacent ink dot having reached the recording medium. This arrangement completely eliminates the possibility of overlapping or cohesion of ink particles even if the ink emitted in the last scanning movement spreads after arrival at the recording medium.

When using the method of random thinning out of the outlets for emission, to ensure random thinning out of ink emission in the last scanning movement of the three scanning movements, the control section 8 controls the recording head 6 so as to cause random emission of ink from the outlet for emitting ink to the portion recorded in the last scanning movement in each band, out of the ink outlets of the recording heads 6. The amount of the ink to be emitted is preferably kept at such a level that the diameter of the ink dot having reached the recording medium is equal to or greater than the distance between the ink dot and an adjacent ink dot having reached the recording medium. This arrangement ensures overlapping or cohesion of adjacent inks emitted in the last scanning movement.

Referring to FIG. 4 (*a*), the following specifically describes which pixel the amount of the ink to be emitted to should be reduced. In FIG. 4 (*a*), the head resolution is the same as the image resolution. For the case where one band is recorded by three scanning movements, the ordinal positions of the pixels where ink is emitted in each scanning movement is expressed as a dot matrix. One horizontal row indicates one band. Each box in the drawing indicates one pixel. Numerals 1 through 3 denote the ordinal numbers of scanning movements when the ink is emitted, with respect to each pixel. For example, in FIG. 4 (*a*), when the band in the first row is recorded, the pixel on the left end of FIG. 4 (*a*) (pixel 1 in the drawing) is recorded in the first scanning movement. The pixels 2 and 3 are recorded in the second and third scanning movements sequentially. Further, when the band of the second row is recorded, the second scanning movement at the time of recording the band of the first row corresponds to the first scanning movement. The fourth scanning movement counting from the first scanning movement at the time of recording the band of the first row corresponds to the third scanning movement. In this manner, each band is recorded by sequentially shifting the scanning movement for starting image recording by one scanning movement.

In the aforementioned process of recording, the control section 8 provides control in such a way that the amount of the ink to be emitted in the portion corresponding to the hatched area in FIG. 4 (*a*) in the third scanning movement as the last scanning movement for recording each band is smaller than that in the first or second scanning movement.

The number of scanning movements required to record one band is not restricted to three. For example, one band can be formed by six scanning movements. In this case, the amount of the ink to be emitted in the sixth movement as the last scanning movement for each band is smaller than that emitted in other scanning movements. For example, when the main scanning movement is carried out in six steps and the image resolution is twice the head resolution, the dot matrix representing the ordinal positions of pixels where the ink is emitted for each scanning movement is as shown in FIG. 4 (*b*). In FIG. 4 (*b*), two rows in the horizontal direction denote one band, and each box in the drawing indicates one pixel. The numerals 1 through 6 show the ordinal numbers of the scanning movements when ink is emitted for each pixel. The control section 8 provides control in such a way that the amount of the ink to be emitted in the portion indicated by hatched area in FIG. 4 (*b*) in the sixth scanning movement as the last scanning movement for band recoding is smaller than that in the first through fifth scanning movements.

The degree of reducing the amount of ink to be emitted is determined by the dot diameter of the ink when it has reached the recording medium P after having been emitted during the last scanning movement for formation of one band, and by the possible increase in the dot diameter with the lapse of time. To be more specific, the dot diameter of ink is much varied depending on the condition of the destination for ink emission. In some cases, the ink expands when reaches the destination. In other cases, the ink reaches in a smaller area of the destination without the dot diameter being increased. Further, after reaching the recording medium P, ink tends to spread with the lapse of time. To reduce the variations in the color tone and glossiness for each band and to ensure high-definition image, the amount of ink to be emitted in the last scanning movement for each band recording is preferred to be such that ink dots are not joined with one another after ink spreads on the recording medium P.

In this respect, the dot diameter of the ink reaching the recording medium P and the degree of an increase in the dot diameter after reaching the recording medium P depend on such factors as the conditions of the ink destination such as the degree of curing of the ink emitted previously and the type of the recording medium P, and the timing of ultraviolet irradiation, that is, time from emission of ink till the ultraviolet irradiation, type of the ink, the intensity of the ultraviolet rays applied from the ultraviolet irradiation device 7, and the ambient temperature and humidity around the recording head 6.

Thus, the amount of ink to be emitted from the recording head 6 in the last scanning movement is determined by the relation to these factors.

Figure 5:
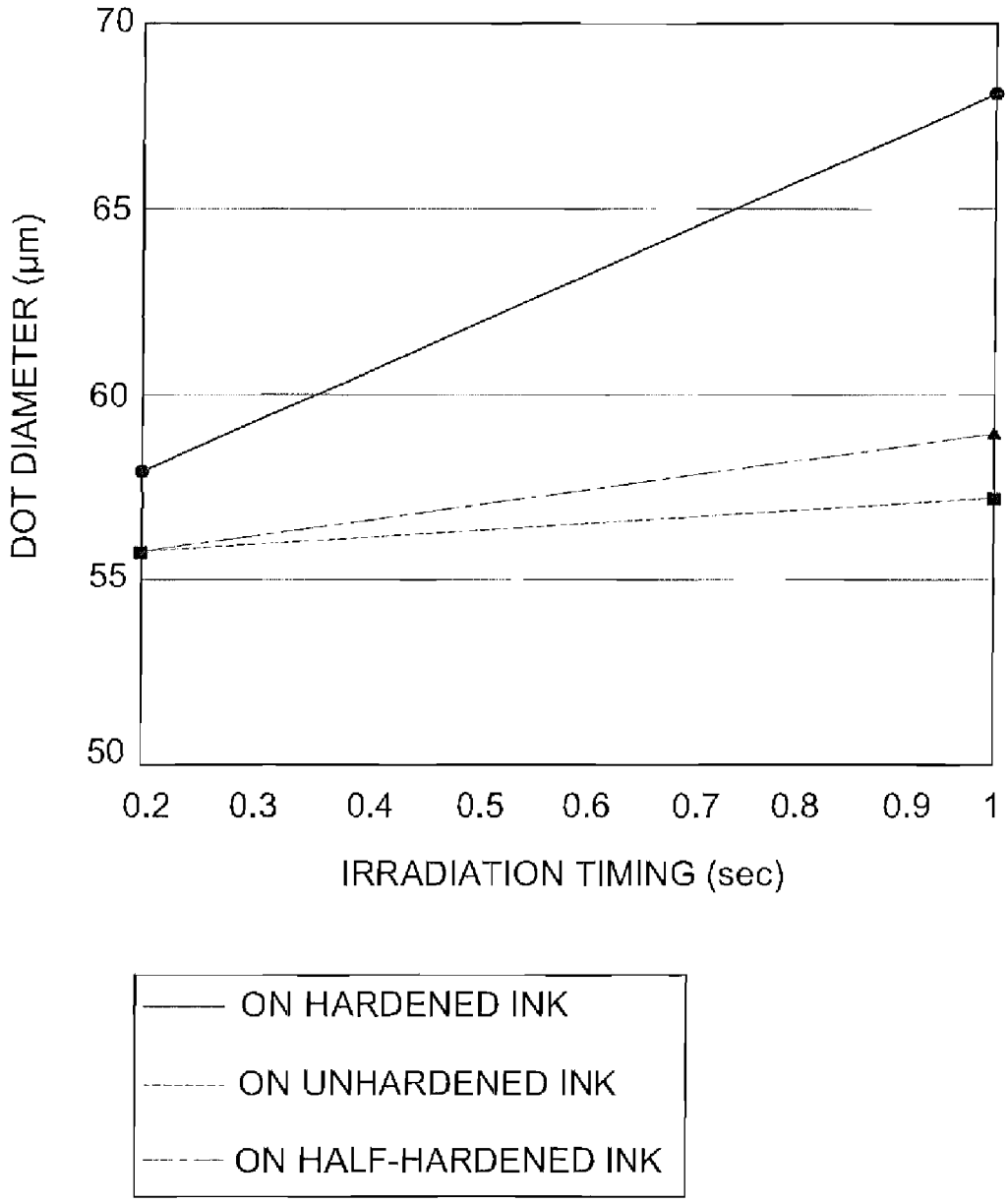
FIG. 5 is a chart representing the relationship between the ink dot diameter and the timing of irradiation for each ink curing status.

As shown in FIG. 5, when the ink having been emitted previously is not yet cured or is half-cured and a new ink is emitted onto this ink, the dot diameter tends to be smaller. By contrast, when the ink having been emitted previously is cured sufficiently and a new ink is emitted onto this ink, the dot diameter tends to be greater.

Figure 6:
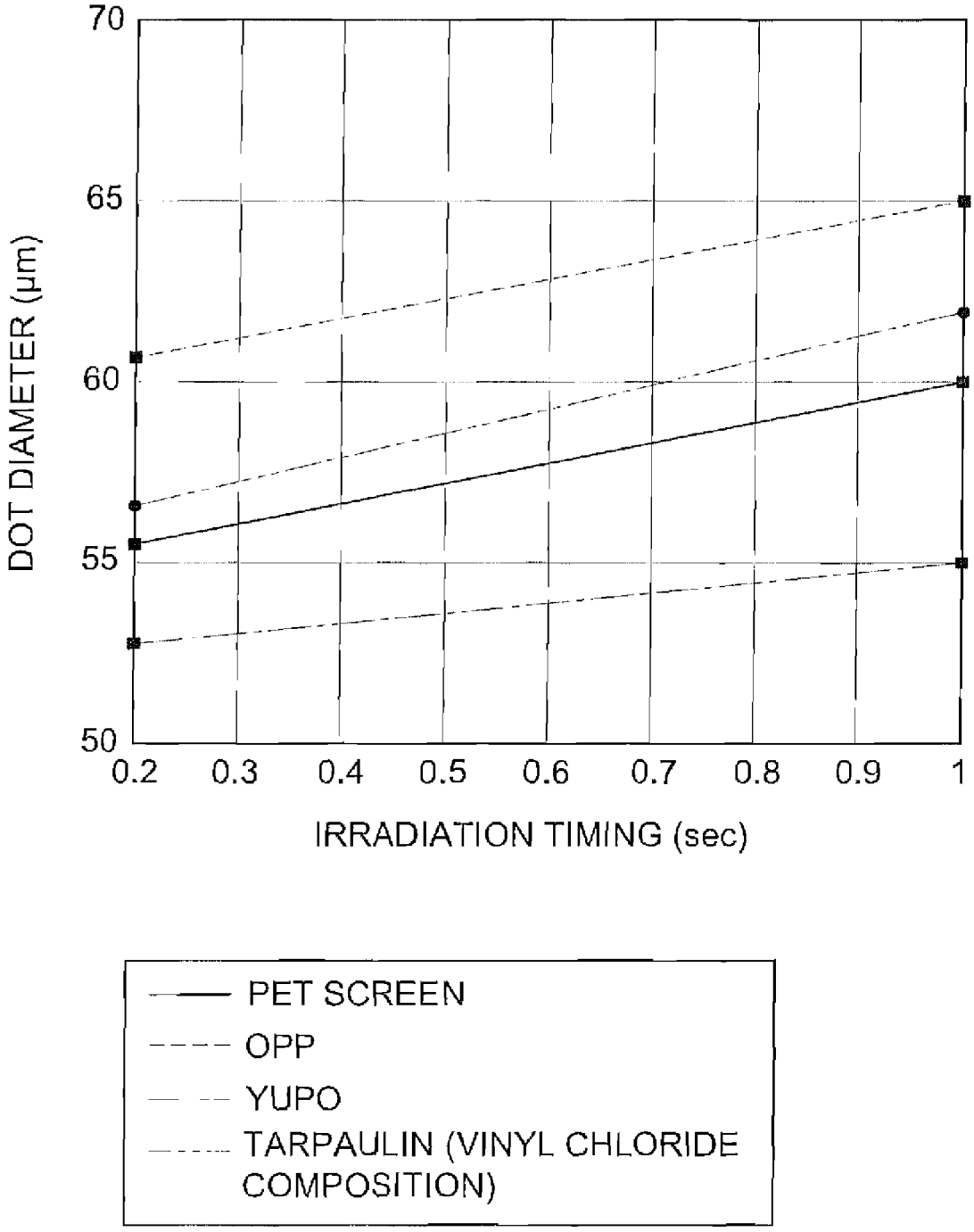
FIG. 6 is a chart representing the relationship between the ink dot diameter and the timing of irradiation for each recording medium.

As shown in FIG. 6, the dot diameter of the ink reaching the recording medium P differs according to the ink absorbency or surface energy of the recording medium P which ink has reached. For example, when ink has reached the recording medium P made of OPP (Oriented Polypropylene) characterized by small surface energy, the ink dot diameter tends to be greater. Conversely, when ink has reached the recording medium P made of Yupo characterized by greater surface energy, the ink dot diameter tends to be smaller.

Thus, when ink dot diameter is increased because of the degree of curing of the ink having been emitted earlier and the type of the recording medium P, the control section 8 provides control in such a way that the amount of the ink to be emitted from the recording head 6 is smaller than that when the ink dot diameter is smaller.

As shown in FIGS. 5 and 6, independently of the degree of curing of the ink having been emitted earlier or the type of the recording medium P, the ink dot diameter tends to increase with the lapse of time if the timing of irradiation is delayed. This is because ultraviolet curable ink is not cured until it is exposed to ultraviolet rays, and therefore, if the timing of ultraviolet irradiation is delayed, the ink having reached the recording medium P spreads before it is exposed to ultraviolet rays.

To be more specific, as shown in FIG. 5, even if the degree of curing the ink having been emitted earlier is the same, the dot diameter is gradually increased with the lapse of time if there is a delay in the timing of irradiation from ink emission till exposure to ultraviolet rays. This trend is conspicuous especially when the ink having been emitted earlier is sufficiently cured.

As shown in FIG. 6, even if ink has been emitted to the same recording medium P, the dot diameter generally tends to increase with the lapse of time if there is a delay in the irradiation timing.

This irradiation timing depends on the distance between each of the recording heads 6 and the ultraviolet irradiation device 7, as well as the image recording speed. To be more specific, for example, when ink has been emitted from the recording head 6 located close to the ultraviolet irradiation device 7 as in the case of yellow (Y) or black (K) in FIG. 1, ultraviolet rays are applied immediately after ink has been emitted. By contrast, when ink has been emitted from the recording head 6 located far from the ultraviolet irradiation device 7 as in the case of cyan (C) and magenta (M), there is much time lag between ink emission and application of ultraviolet rays, and this results in a delay in irradiation timing. Further, as the ink emitted from the recording head 6 located further downstream in the traveling direction of the carriage 4, more time is required between ink emission and application of ultraviolet rays, with the result that there is a greater delay in irradiation timing. Further, when the image recording speed is higher, the traveling speed of the carriage 4 equipped with recording head 6 is also higher, with the result that irradiation is applied earlier. Conversely, when the image recording speed is lower, the traveling speed of the carriage 4 equipped with recording head 6 is also lower, with the result that irradiation is applied later.

Thus, the control section 8 controls the recording head 6 in such a way that the amount of ink to be emitted is smaller when there are factors that delay the irradiation timing.

When ink is made so that it tends to expand ink dots or so that it is not cured easily, adjacent ink dots are more likely to be joined with each other. Thus, the control section 8 provides controlling such a way that the amount of ink having such properties to be emitted in the last scanning movement for each band is smaller than that of other types of ink.

Further, ink tends to be cured more easily when there is a greater amount of ultraviolet ray applied to the ink having reached the recording medium P. The amount of ultraviolet ray is the product of the intensity of the ray applied from the ultraviolet irradiation device 7 and the time of irradiation. Accordingly, even when ultraviolet rays are applied at the same irradiation timing, ink is not cured easily and the dot diameter tends to increase, if the intensity of ultraviolet rays applied from the ultraviolet irradiation device 7 is smaller. By contrast, ink is cured easily and the dot diameter does not tend to increase, if the intensity of ultraviolet rays applied from the ultraviolet irradiation device 7 is greater. Thus, based on the intensity of applied ultraviolet rays detected by the ultraviolet sensor 14, the control section 8 provides control in such a way that, as the irradiation intensity is smaller, the amount of ink to be emitted in the last scanning movement for each band is smaller.

Further, ink is easily cured at a high temperature and low humidity, and not easily cured at a low temperature and high humidity. Thus, based on the ambient temperature and humidity around the recording head 6 detected by the temperature and humidity sensor 13, the control section 8 provides control in such a way that the reduction amount of ink to be emitted in the last scanning movement for each band is larger at a lower temperature and higher humidity.

The storing section 9 of the control section 8 contains an ink emission volume correction table (not illustrated, including the ink thinning rate correction table) for determining the amount of ink to be emitted from the recording head 6, for each of the aforementioned factors affecting the condition of ink curing. Referring to the ink emission volume correction table, the control section 8 determines the amount of the ink to be emitted from the recording head 6.

The following describes the inkjet recording method of the present embodiment:

When the image data inputted from an external apparatus (not illustrated) is sent to the inkjet recording apparatus 1, the image data having been sent is stored in the storing section 9 of the control section 8. Then image recording starting signal, information on the type of the recording medium P and various types of image recording conditions are inputted into the input section 10 by the user. Further, after transmission of the results of detection by the temperature and humidity sensor 13 and ultraviolet sensor 14, the control section 8 reads out the ink emission volume correction table from the storing section 9, and determines the amount of the ink to be emitted in the last scanning movement out of the scanning movements required to form one band, in accordance with the information having been inputted and various types of conditions including the results of detection by the various types of sensors.

After determination of the amount of the ink to be emitted in the last scanning movement out of the scanning movements required to form one band, a decision step is taken to determine the portion of the ink outlets of the recording head 6 wherein the amount of the ink to be emitted is reduced, or the portion wherein ink emission is thinned out, according to the number of the scanning movements to record one band, and the image resolution with respect to the resolution of the recording head 6. It should be noted that the present embodiment is not restricted to the cases wherein the amount of the ink to be emitted in the last scanning movement, the portion of the ink outlets wherein the amount of the ink to be emitted is reduced, and the portion wherein ink emission is thinned out, are determined in the order shown above. For example, they can be determined simultaneously.

When the amount of the ink to be emitted has been determined, the control section 8 controls the recording medium conveyance mechanism 12, whereby the recording media P are intermittently conveyed in sequence downward from the upstream position in the conveyance direction X. Further, the control section 8 controls the carriage drive mechanism 11 so that carriage 4 is moved in the main scanning outward direction A and the main scanning homeward direction B to perform reciprocal scanning over the recording medium P. At the same time, the control section 8 controls the recording head 6 so that a predetermined amount of ink is emitted to a predetermined pixel. The ink emitted onto the recording medium P is exposed to the ultraviolet rays from the ultraviolet irradiation device 7, whereby ink is cured and fixed in position, and an image is recorded on the recording medium P.

As described above, in the present embodiment, the amount of the ink to be emitted in the last scanning movement out of the scanning movements required to form one band is changed in conformity to various types of conditions such as irradiation timing from emission of ink to irradiation of ultraviolet rays, the type of the ink and recording medium P used for image recording, the intensity of applied ultraviolet rays, and the ambient temperature and humidity around the recording head 6. This arrangement minimizes the possible difference in the color tone and glossiness for each band that may have the most serious effect on the quality of the recorded image, and ensures high-definition image recording.

In the present embodiment, the reduction amount of the ink to be emitted in the last scanning movement out of the reciprocal scanning movements required to form one band is determined, with consideration given to all such factors as the distance between the recording head 6 and ultraviolet irradiation device 7, image recording speed, the type of ink, the type of recording medium P, the intensity of ultraviolet rays applied from the ultraviolet irradiation device 7, and the ambient temperature and humidity. However, the amount of the ink to be emitted can be determined, based on any of these factors. In this case, for example, the ultraviolet sensor 14 need not be installed if the intensity of ultraviolet rays applied from the ultraviolet irradiation device 7 is not taken into account. The temperature and humidity sensor 13 need not be installed if the ambient temperature and humidity is not taken into account. This simplifies the apparatus structure.

In the present embodiment, various portions of the apparatus is controlled by one control section 8 as exemplified by the movement of the carriage 4 for reciprocal scanning in the main scanning directions A and B by the carriage drive mechanism 11 and the movement of the recording head 7 operated to emit a predetermined ink. The control structure is not restricted to the one exemplified above. For example, it is possible to provide two control sections; the one is a control section for moving the carriage 4 to perform reciprocal scanning in the main scanning directions A and B by means of the carriage drive mechanism 11, and the other is a control section for controlling emission of a predetermined amount of ink by operation of the recording head 6.

In the present embodiment, the ultraviolet irradiation device 7 is arranged on both sides of the recording heads 6 provided in a group. Without being restricted thereto, the ultraviolet irradiation device 7 can be arranged between the recording heads 6. Further, the ultraviolet irradiation device 7 need not necessarily be mounted on the carriage 4; it can be mounted outside the carriage 4.

In the present embodiment, the ink to be cured by exposure to ultraviolet rays is used for image recording. Without being restricted thereto, it is possible to use the ink that is cured by exposure to the rays other than ultraviolet rays, as exemplified by electron beam, X-rays, visible light, infrared ray and electromagnetic waves. In this case, the polymerizable compound that is cured by polymerization when exposed to the ray other than ultraviolet ray, and the photo-initiator that initiates polymerization reaction between polymerizable compounds when exposed to the ray other than ultraviolet ray are used in the ink. Further, when using the photocurable ink that is cured by the ray other than ultraviolet ray, a light source for that ray is used, instead of the ultraviolet light source.

The recording head 6 used in the inkjet recording apparatus 1 of the present invention can be based on either the on-demand system or continuous system. Any one the electromechanical conversion system (e.g., single cavity type, double cavity type, bender type, piston type, share mode type and shared wall type), electrothermal conversion system (e.g., thermal inkjet type and bubble jet (registered trademark) type), static suction system (e.g., electric field control type and slit jet type) and electrical discharge system (e.g., spark jet type) can be used for emission.

It is to be expressly understood that the present invention is not restricted to the aforementioned embodiments. The present invention can be appropriately modified.

The following describes the second embodiment of the inkjet recording method and inkjet recording apparatus of the present invention. The second embodiment is different from the first embodiment only in the control structure. The following particularly describes the differences from the first embodiment.

The inkjet recording apparatus of the present embodiment is provided with the same recording head and ultraviolet irradiation device as those of the first embodiment (not illustrated), and the control section (not illustrated) containing a storing section for storing various types of programs. Similarly to the case of the first embodiment, the control section is supplied with the information on the result of detection by the temperature and humidity sensor and ultraviolet sensor. Based on this information, the control section adjusts the amount of the ink to be emitted from the recording head.

Especially in the present embodiment, when using the method of reducing the amount of the ink emitted from the outlet, the control section reduces the amount of ink emitted from the aforementioned recording head during both the last scanning movement and the second last scanning movement in the reciprocal scanning movements required to form one band. Similarly to the case of the first embodiment, based on various types of conditions including the distance between the recording head and ultraviolet irradiation device, the image recording speed, the type of ink, the type of the recording medium, and the intensity of ultraviolet rays emitted from the ultraviolet irradiation device, and the ambient temperature and humidity, the control section determines the amount of ink to be emitted in the last scanning movement and the amount of ink to be emitted in the second last scanning movement. In this case, to completely eliminates the possibility of overlapping or cohesion of the adjacent dots of the ink emitted in the last scanning movement and in the second last scanning movement, the dot diameter of the ink having reached the recording medium is preferably equal to or less than half the distance between the ink dot and an adjacent ink dot having reached the recording medium.

Particularly in the present embodiment, when using the method of random thinning out of the outlets for emission, the control section controls the thinning rate of the ink to be emitted from the recording head during both the last scanning movement and the second last scanning movement out of the reciprocal scanning movements required to form one band. Similarly to the case of the first embodiment, based on various types of conditions including the distance between the recording head and ultraviolet irradiation device, the image recording speed, the type of ink, the type of the recording medium, and the intensity of ultraviolet rays emitted from the ultraviolet irradiation device, and the ambient temperature and humidity, the control section determines the thinning rate of ink to be emitted in the last scanning movement and the thinning rate of ink to be emitted in the second last scanning movement. In this case, to ensure overlapping or cohesion of the adjacent dots of the ink emitted in the last scanning movement and in the second last scanning movement, the dot diameter of the ink having reached the recording medium is preferably equal to or greater than the distance between the ink dot and an adjacent ink dot having reached the recording medium.

Similarly to the case of first embodiment, the storing section of the control section contains an ink emission volume correction table (not illustrated, including the ink thinning rate correction table) for determining the amount of ink to be emitted from the recording head 6, for each of the aforementioned factors. Referring to the ink emission volume correction table, the control section determines the amount of the ink to be emitted from the recording head. The ink emission volume correction table can be provided for each of the last scanning movement and the second last scanning movement. Alternatively, one ink emission volume correction table correlating the two scanning movements can be provided.

Other structures are the same as those of the first embodiment, and are not described to avoid duplication.

The following describes the inkjet recording method of the present invention:

When the image data inputted from an external apparatus (not illustrated) is sent to the inkjet recording apparatus 1, the image data having been sent is stored in the storing section of the control section. Similarly to the case of the first embodiment, the control section reads out the ink emission volume correction table from the storing section, and determines the amount of the ink to be emitted in the last scanning movement and the second last scanning movement out of the scanning movements required to form one band, in accordance with various type of information and various types of conditions including the results of detection by the various types of sensors.

After determination of the amount of the ink to be emitted in the last scanning movement and the second last scanning movement out of the scanning movements required to form one band, a decision step is taken to determine the portion of the ink outlets of the recording head wherein the amount of the ink to be emitted is reduced, or the portion wherein ink emission is thinned out, according to the number of the scanning movements to record one band, and the image resolution with respect to the resolution of the recording head.

When the amount of the ink to be emitted has been determined, the control section controls the recording medium conveyance mechanism, whereby the recording media are intermittently conveyed in sequence downward from the upstream position in the conveyance direction. Further, the control section controls the carriage drive mechanism so that carriage is moved in the main scanning direction to perform reciprocal scanning over the recording medium. At the same time, the control section controls the recording head so that a predetermined amount of ink is emitted to a predetermined pixel. The ink emitted onto the recording medium is exposed to the ultraviolet rays from the ultraviolet irradiation device, whereby ink is cured and fixed in position, and an image is recorded on the recording medium.

As described above, in the present embodiment, the amount of the ink to be emitted in the last scanning movement and the second last scanning movement out of the scanning movements required to form one band is changed in conformity to various types of conditions such as irradiation timing from emission of ink till irradiation of ultraviolet rays, the type of the ink and recording medium used for image recording, the intensity of applied ultraviolet rays, and the ambient temperature and humidity around the recording head. This arrangement minimizes the possible difference in the color tone and glossiness for each band that may have the most serious effect on the quality of the recorded image, and ensures high-definition image recording.

In the present embodiment, the amount of the ink to be emitted from the recording head is determined during both last scanning movement and second last scanning movement. Here the amounts of the ink to be emitted in both scanning movements can be the same in both cases. It is also possible to ensure that the amount of the ink to be emitted from the recording head in the last scanning movement is smaller than the amount of the ink to be emitted from the recording head in the second last scanning movement. Since the last scanning movement gives greater effect to the quality of the recorded image, the amount of the ink to be emitted in the last scanning movement is preferably equal to that of the ink to be emitted in the second last scanning movement, or stepwise reduction in the amount of the ink to be emitted is preferably made so that the amount of the ink to be emitted in the last scanning movement is smaller.

Similarly to the case of the first embodiment, the present invention is not restricted to the present embodiment.

The following describes the third embodiment of the inkjet recording method and inkjet recording apparatus in the present invention. The third embodiment is different from the first embodiment only in a part of the apparatus structure and the control structure. The following particularly describes the differences from the first embodiment.

The inkjet recording apparatus of the present embodiment is provided with the same recording head and ultraviolet irradiation device as those of the first embodiment (not illustrated), and the control section (not illustrated) containing a storing section for storing various types of programs. Similarly to the case of the first embodiment, the control section is supplied with the information on the result of detection by the temperature and humidity sensor and ultraviolet sensor. Based on this information, the control section adjusts the amount of the ink to be emitted from the recording head.

Especially in the present embodiment, a desired image quality can be selected from the input section (not illustrated). To ensure the selected image quality, the control section reduces the amount of ink emitted from the recording head during the last in the reciprocal scanning movements required to form one band. Similarly to the case of first embodiment, based on various types of conditions including the distance between the recording head and ultraviolet irradiation device, the image recording speed, the type of ink, the type of the recording medium, and the intensity of ultraviolet rays emitted from the ultraviolet irradiation device, and the ambient temperature and humidity, the control section determines the amount of ink to be emitted in the last scanning movement.

To be more specific, if ink dots are cured independently without being joined with others after arrival of the ink dot to the recording medium, reflected light is easily scattered on the surface of the recorded image. This provides an image having a matte pattern free of glossiness. By contrast, if ink dots are joined with each others, the surface of the recorded image is made flat and a glossy image characterized by glossy tone is provided. Thus, if a matte pattern is selected as desired image quality, control section reduces the amount of ink to be emitted in the last scanning movement to ensure that, when using the method of reducing the amount of the ink emitted from the outlet, ink dots are not joined with each other and, when using the method of random thinning out of the outlets for emission, the number of the positions for mutual cohesion is reduced. By contrast, if the glossy tone is selected as a desired image quality, ink dots have to be joined with each other to some extent. Accordingly, the control section provides control in such a way that the reduction amount of ink to be emitted in the last scanning movement is smaller than that when the matte pattern is selected.

The storing section of the control section is equipped with an ink emission volume correction table (not illustrated, including the ink thinning rate correction table) for determining the amount of ink to be emitted from the recording head, for each of the factors such as the image recording speed and type of the ink as well as a desired image quality. Referring to the ink emission volume correction table, the control section determines the amount of the ink to be emitted from the recording head.

Other structures are the same as those of the first and second embodiments, and are not described to avoid duplication.

The following describes the inkjet recording method of the present embodiment:

When the image data inputted from an external apparatus (not illustrated) is sent to the inkjet recording apparatus 1, the image data having been sent is stored in the storing section of the control section. Then a desired image quality such as a matte pattern and gloss tone is selected and inputted through the input section. Similarly to the case of the first embodiment, the control section reads out the ink emission volume correction table from the storing section, and determines the amount of the ink to be emitted in the last scanning movement out of the scanning movements required to form one band, in accordance with various forms of information as well as the information on various types of conditions including the results of detection by the various types of sensors and selected image quality.

After determination of the amount of the ink to be emitted in the last scanning movement out of the scanning movements required to form one band, a decision step is taken to determine the portion of the ink outlets of the recording head wherein the amount of the ink to be emitted is reduced, or the portion wherein ink emission is thinned out, according to the number of the scanning movements to record one band, and the image resolution with respect to the resolution of the recording head.

When the amount of the ink to be emitted has been determined, the control section controls the recording medium conveyance mechanism, whereby the recording media are intermittently conveyed in sequence downward from the upstream position in the conveyance direction. Further, the control section controls the carriage drive mechanism so that carriage is moved in the main scanning direction to perform reciprocal scanning over the recording medium. At the same time, the control section controls the recording head so that a predetermined amount of ink is emitted to a predetermined pixel. The ink emitted onto the recording medium is exposed to the ultraviolet rays from the ultraviolet irradiation device, whereby ink is cured and fixed in position, and an image is recorded on the recording medium.

As described above, in the present embodiment, the amount of the ink to be emitted in the last scanning movement out of the scanning movements required to form one band is changed in conformity to various types of conditions such as irradiation timing from emission of ink till irradiation of ultraviolet rays, the type of the ink and recording medium used for image recording, the intensity of applied ultraviolet rays, and the ambient temperature and humidity around the recording head. This arrangement minimizes the possible difference in the level of glossiness for each band that may have the most serious effect on the quality of the recorded image, and ensures high-definition image recording.

Further, the amount of the ink to be emitted is adjusted in response to a desired image quality. This arrangement allows the user to select an image of a desired matte pattern and gloss tone, whereby an image of a desired quality can be obtained.

In the present embodiment, the amount of the ink to be emitted from the recording head is reduced only in the last scanning movement out of the reciprocal scanning movements required to form one band. However, similarly to the case of the second embodiment, the amounts of the ink to be emitted from the recording head in both the last scanning movement and second last scanning movement can be reduced.

Similarly to the case of the first and second embodiments, the present invention is not restricted to the present embodiment.

The invention claimed is:

1. An inkjet recording method for recording an image comprising:

conducting reciprocal scanning movements of a recording head in a direction perpendicular to a conveyance direction of a recording medium, emitting a photocurable ink from the recording head onto the recording medium, the photocurable ink being cured by application of light;

applying light to the emitted ink; and controlling so that a smaller amount of ink is emitted from the recording head during a last step of the reciprocal scanning movements required to form one band than before the last step, when recording is performed so as to form one band by a plurality of reciprocal scanning movements of the recording head.

2. The inkjet recording method of claim 1 wherein the smaller amount of ink is ink resulting from reducing an amount of ink emitted from an outlet.

3. The inkjet recording method of claim 1 wherein the smaller amount of ink is ink resulting from random thinning out of outlets from which ink is emitted.

4. The inkjet recording method of claim 1 wherein the last step is a last scanning movement.

5. The inkjet recording method of claim 1 wherein the last step is a last scanning movement and a second last scanning movement.

6. An inkjet recording apparatus comprising:

a recording head for emitting a photocurable ink onto a recording medium, the photocurable ink being cured by application of light;

a light irradiation apparatus including a light source for applying light to the emitted ink;

a head scanning section for conducting reciprocal scanning movements of the recording head in a direction perpendicular to a conveyance direction of the recording medium; and a control section for determining an amount of ink to be emitted and for controlling the recording head so as to reduce an amount of ink emitted from the recording head during a last step of the reciprocal scanning movements required to form one band with respect to the amount of ink before the last step, when the head scanning section is operated and recording is performed so as to form one band by a plurality of reciprocal scanning movements of the recording head.

7. The inkjet recording apparatus of claim 6 wherein the control section reduces the amount of ink to be emitted by reducing an amount of ink emitted from an outlet.

8. The inkjet recording apparatus of claim 7 wherein the control section controls the recording head so that the amount of ink emitted from the recording head during the last step of the reciprocal scanning movements required to form one band is kept at such a level that a diameter of an ink dot having reached the recording medium is equal to or less than half a distance between the ink dot and an adjacent ink dot having reached the recording medium.

9. The inkjet recording apparatus of claim 6 wherein the control section reduces the amount of ink to be emitted by random thinning out of outlets for ink emission.

10. The inkjet recording apparatus of claim 9 wherein the control section controls the recording head so that the amount of ink emitted from the recording head during the last step of the reciprocal scanning movements required to form one band is kept at such a level that a diameter of an ink dot having reached the recording medium is equal to or greater than a distance between the ink dot and an adjacent ink dot having reached the recording medium.

11. The inkjet recording apparatus of claim 6 wherein the last step is a last scanning movement.

12. The inkjet recording apparatus of claim 6 wherein the last step is a last scanning movement and a second last scanning movement.

13. The inkjet recording apparatus of claim 6 wherein a plurality of the recording heads are arranged and the control section determines the amount of ink to be emitted in response to a distance between the recording head and the light irradiation apparatus.

14. The inkjet recording apparatus of claim 6 wherein a plurality of the recording heads are arranged to adapt to each of ink colors and the control section determines the amount of ink to be emitted in response to a type of the ink.

15. The inkjet recording apparatus of claim 6 wherein the control section determines the amount of ink to be emitted in response to a type of the recording medium.

16. The inkjet recording apparatus of claim 6 wherein the control section determines the amount of ink to be emitted in response to an image recording speed at a time of image recording.

17. The inkjet recording apparatus of claim 6, further comprising:

an irradiation intensity measuring section for measuring irradiation intensity of light applied from the light irradiation apparatus wherein the control section determines the amount of ink to be emitted in response to the irradiation intensity measured by the irradiation intensity measuring section.

18. The inkjet recording apparatus of claim 6, further comprising:

a temperature and humidity measuring section for measuring at least one of temperature and humidity around the recording head wherein the control section determines the amount of ink to be emitted in response to at least one of temperature and humidity around the recording head measured by the temperature and humidity measuring section.

19. The inkjet recording apparatus of claim 6 wherein the control section determines the amount of ink to be emitted in response to a desired quality of an image to be recorded.

* * * * *